US012768246B2

(12) United States Patent
Swick

(10) Patent No.: US 12,768,246 B2
(45) Date of Patent: Oct. 20, 2026

(54) VALVE SYSTEM AND FLUID DRIVEN DOWNHOLE SYSTEM AND METHOD

(71) Applicant: Advanced Drilling Tools Pty Ltd, Hazelmere (AU)

(72) Inventor: Randal Swick, Hazelmere (AU)

(73) Assignee: Advanced Drilling Tools Pty Ltd, Hazelmere (AU)

( * ) Notice: Subject to any disclaimer, the term of this patent is extended or adjusted under 35 U.S.C. 154(b) by 0 days.

(21) Appl. No.: 18/873,320

(22) PCT Filed: Jun. 9, 2023

(86) PCT No.: PCT/AU2023/050516

§ 371 (c)(1),
(2) Date: Dec. 9, 2024

(87) PCT Pub. No.: WO2023/235940

PCT Pub. Date: Dec. 14, 2023

(65) Prior Publication Data

US 2025/0327370 A1 Oct. 23, 2025

(30) Foreign Application Priority Data

Jun. 9, 2022 (AU) ..... 2022901583

(51) Int. Cl.
*E21B 34/10* (2006.01)
*E21B 21/10* (2006.01)
(Continued)

(52) U.S. Cl.
CPC ..... *E21B 34/10* (2013.01); *E21B 21/10* (2013.01); *E21B 34/12* (2013.01); *E21B 47/00* (2013.01)

(58) Field of Classification Search
CPC . E21B 34/10; E21B 21/10; E21B 6/00; E21B 2200/04; E21B 2200/02
See application file for complete search history.

(56) References Cited

U.S. PATENT DOCUMENTS 3,763,940 A * 10/1973 Mott ..... E21B 21/103 137/460
4,478,244 A 10/1984 Garrett
(Continued)

OTHER PUBLICATIONS

International Search Report and Written Opinion of the International Searching Authority in relation to International Application No. PCT/AU2023/050516, dated Aug. 1, 2023, 15 pages.

*Primary Examiner* — Kenneth L Thompson
(74) *Attorney, Agent, or Firm* — Bochner PLLC; Andrew D. Bochner

(57) ABSTRACT

A compressed fluid driven downhole system 12 comprises a drill string 16 forming a fluid flow path 20. The drill string 16 has an up hole end and a down hole end. A downhole tool 14, which is driven by compressed fluid is coupled to the downhole end of the drill string 16. A valve system 10 is coupled to the tubular at a location up hole of the downhole tool 14. The valve system 10 is operable to selectively: open the fluid flow path 20 allowing compressed fluid to flow to drive the downhole tool 14; and, close the fluid flow path 20 preventing compressed fluid from flowing to and out of the downhole tool 14. Therefore, when re pressurizing the drill string following the connection of a new drill pipe compressed fluid delivered down the dill pipe is prevented from flowing to through downhole tool and into hole until the valve system is opened. The valve system 10 may be controlled to open when the pressure of the compressed gas in the drill string up hole of the valve system reaches a threshold pressure. The threshold pressure may be greater than ambient downhole pressure and less than or equal to an operating pressure of the downhole tool.

11 Claims, 2 Drawing Sheets

(51) Int. Cl.
*E21B 34/12* (2006.01)
*E21B 47/00* (2012.01)

(56) References Cited

U.S. PATENT DOCUMENTS

| | | | | |
|---|---|---|---|---|
| 4,683,956 | A * | 8/1987 | Russell | E21B 17/1014 166/383 |
| 5,421,420 | A * | 6/1995 | Malone | E21B 21/10 175/321 |
| 6,439,321 | B1 * | 8/2002 | Gillis | E21B 23/006 166/383 |
| 9,556,707 | B2 * | 1/2017 | Vick, Jr. | E21B 34/066 |
| 10,472,930 | B2 * | 11/2019 | Jepp | E21B 21/103 |
| 10,570,685 | B2 * | 2/2020 | Date | E21B 34/14 |
| 11,047,207 | B2 * | 6/2021 | Janes | E21B 34/06 |
| 11,371,317 | B2 * | 6/2022 | Inglis | E21B 47/12 |
| 11,788,378 | B2 * | 10/2023 | Towers | E21B 34/066 166/66.6 |
| 2006/0272810 | A1 | 12/2006 | Marsh | |
| 2008/0223467 | A1 | 9/2008 | Tveita | |

* cited by examiner

VALVE SYSTEM AND FLUID DRIVEN DOWNHOLE SYSTEM AND METHOD

TECHNICAL FIELD

A valve system is disclosed. Also disclosed is fluid driven down hole system and method that may optionally incorporate the valve system. The valve system has particular, but not exclusive, utility in the field of downhole drilling and associated tools that utilise a compressed gas such as hammer drills, rotary drills and development tools.

BACKGROUND ART

One known method of downhole drilling comprises using a tubular in the form of a single wall drill string to deliver a fluid to a downhole drilling tool such as a down the hole hammer drill or tri-cone drilling bit. The fluid may be a compressed gas, a liquid or a gas/liquid mixture. The pressure of the fluid required to efficiently operate the down hole drilling tool progressively increases as downhole depth increases. This is because the fluid pressure at the down hole end of the drill string must be sufficient to overcome the ambient downhole pressure, at the drilling tool, and also provide sufficient pressure and volume of the fluid to also carry drill cuttings away from the drilling face and clear of the hole.

When the drill string is composed of a plurality of end-to-end connected drill pipes it is necessary to continuously add drill pipes to the string in order to progress the drilling depth. For example, if the drill pipes are 6 m long then, after every additional 6 m of drilling, a new drill pipe is required in order to progress the hole depth. When a new drill pipe is added the supply of compressed gas that would otherwise be delivered down the string to the drilling tool is shut off via a supply valve situated on the surface between the operating fluid supply and hole. Therefore, the fluid pressure within the drill string reduces to ambient pressure as it is either vented at surface and/or drains through the drilling tool in the absence of any valving.

Once the additional pipe has been added the supply valve is opened allowing the fluid to be delivered down the string to the drilling tool. The time taken for the pressure within the string to build to the operating pressure of the drilling tool may be considerable (for example more than 5 minutes) and in any event increases with hole depth. The reasons for the increase in time to achieve an efficient operating pressure as the hole progresses is predominantly due to three factors:

i) As the hole depth increases the internal volume of the drill string increases and thus additional fluid is required to achieve an efficient operating pressure;

ii) The drilling tools commence to pass the compressed fluid prior to the efficient operating pressure has been achieved. This is analogous to filling a bucket with a hole in it—with a lot of water passing out of the hole preventing the bucket from filling quickly.

iii) As the hole progresses in depth the efficient operating pressure of the drilling tools generally increases due to the need to overcome frictional losses and additional hydrostatic head if drilling under water The disclosed valve system has been designed with a view to facilitate a reduction in the time taken to recommence the efficient operation of a downhole tool, such as but not limited to a downhole drilling tool, after a pause in operation such as when adding a drill pipe to a drill string.

The above references to the background art do not constitute an admission that the art forms a part of the common general knowledge of a person of ordinary skill in the art. The above references are also not intended to limit the application of the drive sub as disclosed herein.

SUMMARY OF THE DISCLOSURE

In broad and general terms, the valve system is contemplated for installation in a fluid flow path that carries compressed/pressurised fluid down a drill string to power a down hole tool. After powering the tool, the fluid exits the hole, and in the case of a drilling operation, flushes the hole clean of drill cuttings. The valve system may be located immediately prior to the downhole tool but could be located up hole, towards the fluid supply, of the downhole tool. In some embodiments the down hole tool may be a drilling tool. The salve system is designed such that it can selectively open and close the fluid flow path to prevent the operating fluid from flowing to and out of the down hole tool. Therefore, when the valve system is closed, the time taken to build-up operational pressure within the drill string, for example after adding a drill pipe, is reduced because the fluid does not now flow through the drilling tool. Optionally the valve system may be used in conjunction with one or more upstream check (or commonly known as "one way") valves. This is particularly useful when the operating fluid is a compressed gas. This forms a pressure retention arrangement that is able to retain an above ambient pressure of the compressed fluid within a length of the fluid flow path after the flow of the operating fluid into the path has been turned OFF. The fluid flow path may be provided as a drill string constructed from a plurality of end-to-end connected drill pipes.

An operational advantage of this with reference to down hole drilling is that when it is desired to recommence drilling after the additional of a drill rod to a drill string, less time is required to build the pressure within the drill string to the operating pressure, due to the retained fluid in pressurised section of the fluid flow path. As a consequence, effective drilling times and production rates can be increased resulting in lower drilling costs, faster completion times and reduced GHG (greenhouse gas) emissions from reduced energy consumption.

In one aspect there is disclosed a fluid driven downhole system comprising:

- a tubular forming a fluid flow path, the tubular having an up hole end and a down hole end;
- a downhole tool, coupled to the downhole end of the tubular, capable of being driven by fluid; and
- a valve system coupled to the tubular and located up hole of the downhole tool, the valve system being operable to selectively: open the fluid flow path allowing fluid to flow to drive the downhole tool; and, close the fluid flow path preventing fluid from flowing to and out of the downhole tool.

In one embodiment the valve system is arranged to open when pressure of the fluid in the tubular reaches a threshold pressure.

In one embodiment the threshold pressure is a pressure between ambient downhole pressure and operating pressure of the downhole tool.

In one embodiment the valve system is arranged to allow a small bleed of compressed fluid to pass in its closed state.

In one embodiment the valve is controlled to open when the tubular is rotating.

In one embodiment the fluid driven downhole system includes one or more check valves located in the fluid flow path between the valve system and the up hole end of the tubular, the one or more check valves arranged to allow a flow of fluid in a down hole direction only.

In one embodiment the downhole tool is a drilling tool.

In one embodiment the tubular is a drill string comprises of a series of end to end connected drill pipes.

In one embodiment the valve system is arranged to open incrementally between the open and closed positions.

In one embodiment the actuator is operated to move the valve between the opened and closed position one the basis of any one of, or any combination of two or more of: rotation of the drill string; fluid pressure within the tubular; a particular or specific rotation sequence of the downhole tool; the effluxion of time; vertical movement of the downhole tool; depth of the downhole tool; a pressure differential; and, air fluid flow rate though the drill string.

In one embodiment the valve system includes:

a valve located in the fluid flow path, the valve progressively movable between a fully open position in which fluid can flow past the valve and through the fluid flow path without restriction, and a closed position in which compressed fluid is prevented from passing the valve and flowing through the fluid flow path to the down hole tool; and an actuator arranged to move the valve between the opened position and the closed position dependent on at least one of: a rotational state of the tubular; and a pressure differential between a fluid in the fluid flow path and a reference pressure.

In one embodiment the valving system includes an accumulator, and wherein the actuator is selectively exposed on one side to pressure within the fluid flow path, and exposed on an opposite side to pressure within the accumulator.

In one embodiment the valving system includes an accumulator, and wherein the actuator is selectively exposed on one side to pressure of fluid in the from a supply of the fluid, and exposed on an opposite side to pressure within the accumulator.

In one embodiment the fluid driven downhole system includes a controller having a rotation sensor for sensing a rotational state of the valve system and, a fluid supply line capable of communicating fluid pressure in the fluid flow path to the actuator.

In one embodiment the controller includes an internal valve arranged to open and close fluid communication between the fluid flow path and the fluid supply line.

In one embodiment the actuator is operated electrically.

In one embodiment the valve system is arranged to open incrementally between the open and closed positions.

In one embodiment the actuator is operated to move the valve between the opened and closed position one the basis of any one of, or any combination of two or more of: rotation of the drill string; fluid pressure within the tubular; a particular or specific rotation sequence of the downhole tool; the effluxion of time; vertical movement of the downhole tool; depth of the downhole tool; a pressure differential; and, air fluid flow rate though the drill string.

In a second aspect there is disclosed a method of adding a drill pipe to a drill string of a compressed gas driven downhole drilling system having a downhole drilling tool coupled to a downhole end of the drill string, the method comprising:

shutting off a supply of compressed gas to the drilling string;

closing a valve in drill string and up hole of the downhole drilling tool;

disconnecting an up hole end of the drill string from a rotation head;

connecting a new drill pipe to an up hole end of the disconnected drill string; reconnecting the drill string via the new drill pipe to the rotation head;

supplying compressed gas to the drill string;

opening the valve when pressure of the compressed gas in the drill string up hole of the valve reaches a threshold level, wherein the compressed gas is able to flow to and through the down hole drilling tool.

In one embodiment the threshold pressure is a pressure between ambient downhole pressure and operating pressure of the downhole drilling tool.

In one embodiment the valve is arranged to allow a small bleed of compressed fluid to pass when the valve is closed.

In one embodiment the method includes opening the valve when the drill string is rotating.

In one embodiment the method includes installing one or more check valves in the drill string up hole of the valve, the one or more check valves arranged to allow a flow of fluid in a down hole direction only.

In a third aspect there is disclosed a method of downhole drilling using a drill string constructed from a plurality of end-to-end connected drill pipes and a drilling tool coupled to a downhole end of the drill string, the drill string forming a fluid flow path for compressed fluid to operate the drilling tool, the method comprising:

closing the fluid flow path at a first location up hole of the drilling tool prior to delivering compressed gas down the drill string following connecting of a drill pipe to the drill string;

delivering compressed gas down the drill string; and opening the fluid flow path at the first location after when pressure of the delivered compressed gas in the drill string up hole of the first location reaches a threshold pressure.

In one embodiment the method includes prior to commencing the connection of the drill pipe, closing the fluid flow path at a second location up hole of the first location to a flow of compressed gas in an up hole direction past the second location, to from a closed length portion of the drill pipe between the first and second locations capable of at least partially retaining pressure of the compressed during connection of the drill pipe.

In one embodiment closing the fluid flow path at the first location comprises allowing a small bleed of compressed fluid to pass through the drilling tool to maintain a positive fluid pressure in the drilling tool relative to ambient down hole pressure In a fourth aspect there is disclosed a method of downhole drilling using a drill string constructed from a plurality of end-to-end connected drill pipes and a drilling tool coupled to a downhole end of the drill string, the drill string forming a fluid flow path for compressed fluid to operate the drilling tool, the method comprising:

closing a length of the fluid flow path during connection of a drill pipe to the drill string wherein the closed length of the fluid flow path retains the compressed fluid.

In one embodiment closing the length comprises allowing a small bleed of compressed fluid to pass through the drilling tool to maintain a positive fluid pressure in the drilling tool relative to ambient down hole pressure.

BRIEF DESCRIPTION OF THE DRAWINGS

Notwithstanding any other forms which may fall within the scope of the valve system and the compressed fluid driven downhole system as set forth in the Summary, specific embodiments will now be described, by way of example only, with reference to the accompanying drawings in which.

DETAILED DESCRIPTION OF SPECIFIC EMBODIMENTS

Figure 2:
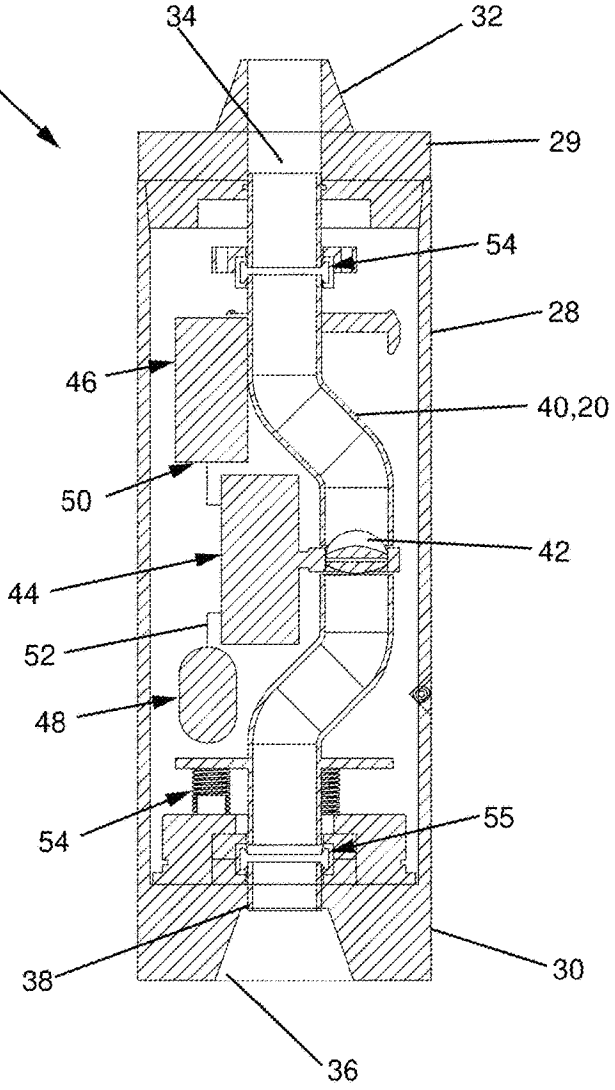
FIG. 2 is a view of section A-A of the valve system shown in FIG. 1.
Figure 1:
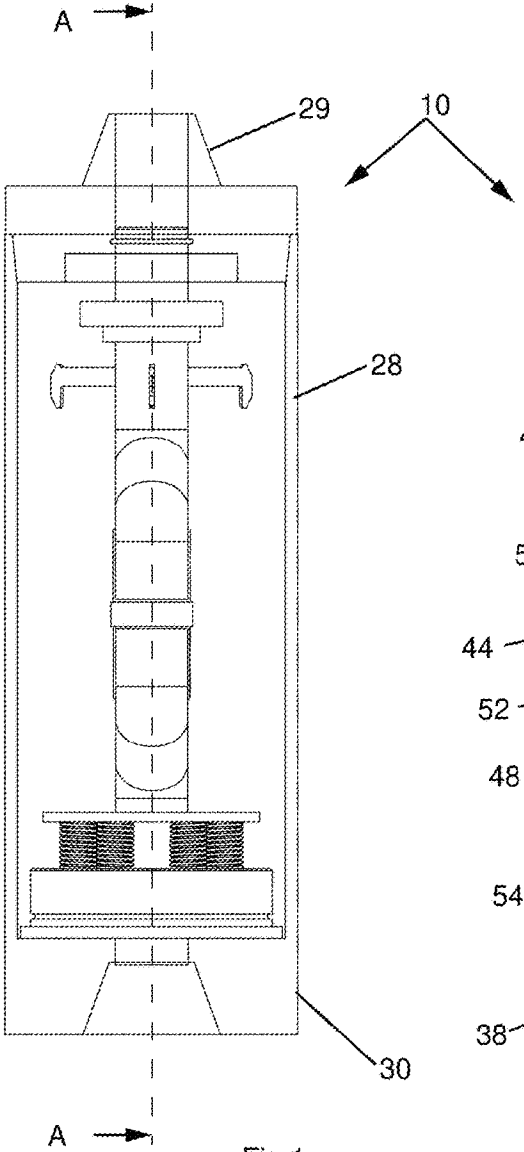
FIG. 1 is a front view of an embodiment of the disclosed valve system.
Figure 3:
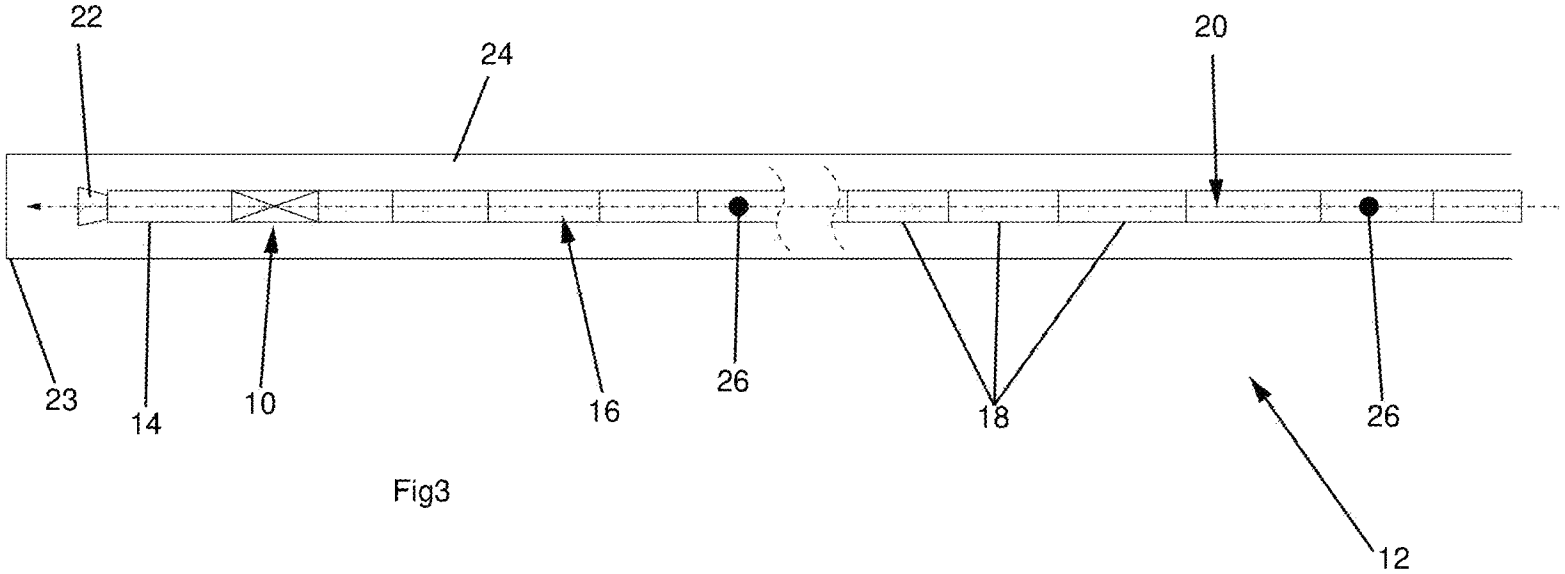
FIG. 3 is a schematic representation of a compressed fluid driven down hole system incorporating the disclosed valve system.

Specific embodiments of the disclosed valve system and associated fluid driven downhole system will now be described by way of example only. The terminology used herein is for the purpose of describing particular embodiments only, and is not intended to limit the scope of the disclosed valve system and associated compressed fluid driven downhole system. Unless defined otherwise, all technical and scientific terms used herein have the same meanings as commonly understood by those of ordinary skill in the art of Valve Systems and associated compressed fluid driven downhole systems. In the drawings, like reference numbers refer to like parts.

The accompanying drawings depict an embodiment of the disclosed valve system 10 installed in a fluid driven downhole system 12. In this embodiment the fluid driven downhole system 12 is a compressed air driven downhole hammer 14 coupled to a downhole end of a tubular in the form of a drill string 16. The drill string 16 is constructed from a plurality of end-to-end connected drill pipes 18. The drill string 16 forms a fluid flow path 20 through which compressed air flows to the downhole hammer 14. The compressed air reciprocates a piston (not shown) within the hammer 14 which strikes a drill bit 22 providing impact to the toe 23 of a hole 24 being drilled by the system 12. The compressed air with entrained drill cuttings then returns to the surface through an annulus between the drill string 16 and the inside of the hole 24.

The valve system 10 is arranged to selectively open and close the fluid flow path 20 based upon one or more parameters. These parameters may include but are not limited to any one of, or any combination of two or more of: rotation of the drill string: fluid pressure within the drill string 16; a particular or specific rotation sequence of the downhole tool; the effluxion of time; vertical movement of the downhole tool; depth of the downhole tool; and fluid flow rate though the drill string. Moreover, the valve system 10 in effect becomes a part of the fluid flow path 20. When closed, the valve system 10 closes the fluid flow path 20 and therefore prevents compressed air from reaching the hammer 14 and subsequently flowing out of the downhole hammer 14 into the hole 24.

To extend the depth of the hole 24 being drilled, a new drill pipe 18 is connected at the up hole end of the drill string 16. This involves shutting off the supply of compressed air to the downhole hammer 14, disconnecting the up hole end of the string from an associated drill head and, threadingly connecting one end of a new drill pipe 18 to the up hole end of the string 16. During this process the disclosed valve system 10 is closed and the fluid flow path 20 vents to atmosphere through the up hole end of the drill string. Once the new pipe 18 has been connected to the drill string 16 and the opposite end is coupled to the drill head compressed air is again delivered down the drill string 16 to the closed valve system 10.

Since the valve system 10 is closed, no compressed air is able to reach the hammer 14 and flow into the hole 24. Therefore, the air pressure within the drill string 16 up to the valve system 10 progressively increases faster than would be the case in identical conditions in the absence of the valve system 10. When the pressure builds to a threshold pressure, or a signal is sent, the valve system 10 is opened allowing the compressed air to flow to the hammer 14. The threshold pressure may be in a range greater than ambient down the hole pressure and less than or to the required operating pressure for the hammer 14 as at particular hole depth. In one example the threshold pressure can be a fixed pressure (e.g., 100 psi) less than operating pressure. The Valve System 10 can be opened on the basis of:

(a) the threshold pressure being reached irrespective of whether the drill string is rotating;

(b) the threshold pressure being reached and the drill string is sensed as rotating;

(c) the drill string is sensed as rotating.

The benefit of the valve system 10 may be enhanced by the installation one or more optional check valves 26 in the fluid flow path 20 upstream of the valve system 10, particularly when the operating fluid is a compressed gas. The check valves 26 allow fluid flow in a downhole direction only, preventing or reducing the venting of compressed air to the atmosphere during a rod connection. Accordingly, for the length/volume of the drill string 16 between the valve system 10 and an upper most check valve 26, a body of the compressed air can be retained subject to normal losses and leakage. For example, if the air pressure for driving the hammer 14 at a particular depth is 500 psi, and it is necessary to add a new drill pipe, then before commencing the connection of the new drill pipe, the valve system 10 is signalled to close. The pressure in the fluid flow path 20 between the valve system 10 and an upper most of the check valves 26 may reduce to, for example, 380 psi due to normal or controlled leakage in the time taken to add the new drill pipe 18.

When drilling is ready to recommence, the compressed air supply is reactivated but now needs only to build up to an operating pressure: (a) from ambient pressure for the length of drill string between the upper most check valve 26 and the rotation head; and, (b) from the 380 psi retained pressure, rather than ambient pressure, for the length of drill string between the upper most check valve 26 and the valve system 10. As before, the valve system 10 will remain closed until the threshold pressure is attained or an opening signal is received. Consequently, when one or more check valves are also incorporated, the time taken, and energy required to build air pressure back to the operating pressure at the hammer 14 is further reduced.

In one embodiment the valve system 10 may also be arranged to allow a small bleed of compressed fluid to pass in its closed state. This maintains a positive pressure in the drilling tool (hammer 14) preventing it from being blocked with drill cuttings or dirt flowing backwards into the drill string and/or drilling tool during a rod change. While this is not a common problem it does occur occasionally and is problematic, often resulting in the rods and drilling tools being removed from the hole to be cleared.

Referring specifically to FIG. 2 the present embodiment of the valve system 10 includes an outer pipe 28 with end caps 29 and 30 at axially opposite ends. In this example the end cap 29 is formed with an outwardly projecting male thread 32 for connecting to a downhole end of the drill string 16, and an axially extending internal passage 34. The end cap 30 is formed with a female thread 36 for connection to the hammer 14, and has an axially extending internal passage 38. An internal pipe 40 is housed within the outer pipe 28 and provides a fluid communication path between the passages 34 and 38. The pipe 40 is in fluid communication with, and becomes a part of, the fluid flow path 20. The system 10 also includes a valve 42, an actuator 44, a controller 46 and an accumulator 48.

The valve 42 is located within the pipe 40 and can be moved by the actuator 44 between an opened position in which compressed air can flow through the pipe 40 to the downstream hammer 14, and a closed position where the gate 42 closes the pipe 40 to prevent the flow of compressed air to the hammer 14. This consequently prevents the venting of the compressed air in fluid flow path 20, through the hammer, to the downhole environmental pressure. The movement of the actuator between the opened and closed positions may be incremental, or progressive.

The controller 46 includes various electronic components and sensors which may include a rotation sensor, a timer, pressure sensors, accelerometer, a PLC or microprocessor; as well as internal valves. A battery for providing operational power may be held within the controller 46 or elsewhere within the valve system 10. The controller 46 is arranged to sense air pressure within the fluid flow path 20 (including the pipe 40) and rotation of the drill string 16. This may be used for determining when to open and close the fluid flow path 20. The controller 46 is operatively connected to the actuator 44 by a supply line 50 which can energise the actuator hydraulically, pneumatically or electrically.

In one embodiment the actuator 44 is in the form of a pneumatic ram having an internal piston (not shown). The piston can be acted upon on opposite sides by the air pressure in the fluid flow path 20 via the supply line 50, and air pressure in the accumulator by the supply line 52. The air pressure in the accumulator 48 can be set at a pressure above ambient pressure and forms a closed fluid system with the actuator 44. The accumulator air pressure can be adjusted using suitable valving, filters and the pressurised drilling fluid itself. For example, in one embodiment a 100 psi check valve can be used so that the pressure in the accumulator 48 is 100 psi below the max drilling pressure. Thus, in this example the threshold operating pressure of the valve system 10 is 100 psi below the operating pressure of the hammer.

In this way the actuator works on the basis of pressure differential between the hammer operating/driving pressure and the accumulator pressure. This is independent of environmental pressure.

During drilling operations, the drill string 16 is rotating and the air pressure in the fluid flow path 20 is at the required pressure for driving the hammer 14 at the given hole depth. The controller 46 senses the rotation of the drill string and holds open its internal control valves to allow the air pressure in the fluid flow path 20 to be communicated to the actuator 44. This air pressure overcomes the air pressure in the accumulator 48 so that the actuator 44 holds the valve 42 open.

When a new drill pipe 18 is to be added to the drill string 16, the rotation of the drill string is stopped and the supply of compressed air to the fluid flow path 20, turned OFF, for example by operating a compressor valve. The controller senses the cessation of the rotation as well as a drop in air pressure in the fluid flow path 20. The controller holds its internal controller valves open exposing the actuator 44 via the supply line 50 to the dropping air pressure in the fluid flow path 20. The pressure in the accumulator 48 overcomes the dropping pressure in the fluid flow path 20 causing the actuator to close the valve 42. This prevents any further flow of air past the valve system 10. If one or more optional check valves 26 are incorporated, the air pressure within the fluid flow path 20 between the valve system 10 and the upper most check valve 26 is now captured and held, subject to normal, or controlled, leakage.

After the connection of the new drill pipe 18 the drill string is reconnected to the rotation head and the air compressor valve turned ON. The controller 46 senses the rotation of the drill string 16. When the air pressure above the upper most check valve 26 overcomes the retained pressure, the sensors in the controller also detect an increase in the pressure within the flow path 20. The controller then opens its internal control valves so that the air pressure within the fluid flow path 20/string 16 is communicated to the actuator 44. As the air pressure in the path 20 rises it eventually overcomes the lower air pressure in the accumulator 48. This causes the piston in the actuator 44 to move which in turn moves and/or holds the valve 42 in the open position. The compressed air is now able to flow to and drive the hammer 14. The compressed air is then exhausted from the hammer 14 and flows back up the hole 24 carrying with it drill cuttings.

The controller 46 is able to monitor various rotation and pressure signals and the PLC or microprocessor may be pre-programmed to operate the valve system 10 in various ways. One such pre-program may be arranged to gently unload the hole 24 for example by partially opening the valve 42 after the recommencement of drilling to allow a progressive, rather than instantaneous, increase in fluid pressure at the toe 23 of the hole. The rotation of the drill string 16 can be used to signal the controller 46 to open or close the valve 42 in accordance with the particular program. This includes sensing for example no rotation for a particular period of time together with no linear acceleration, indicating that the drill string is not being pulled from the hole 24. In this instance the valve system 10 may be programmed to go into an open state where it deactivates with the valve 42 held open.

The valve system 10 may include vibration isolation mechanisms 54 to isolate the pipe 40, actuator 44, controller 46 and accumulator 48 from vibrations arising from the operation of the drill string 16. Seals can also be provided either as part of the vibration isolation mechanisms 55 or standalone items for providing a sealed connection between opposite ends of the pipe 40 and the drill string 16 on one side and the hammer 14 on the other.

While several exemplary embodiments have been presented in the foregoing detailed description, it should be appreciated that a vast number of variations exist. For example, while the compressed fluid in the described embodiment is air, it may be other gases such as nitrogen or a gas and liquid mixture. In another variation instead of using the fluid flow through the pipe 40 for operating the valve 42 the system 10 may be provided with an independent supply of compressed fluid for this purpose. This may take the form of a cylinder of compressed fluid for example, but not limited to, CO2. The cylinder would be retained within the outer pipe 28. In yet another variation instead of using a fluid either from the pipe 40 or an independent supply, the valve can be operated electrically for example by use of a solenoid. The solenoid can be controlled to open and close the valve 42 as required dependent on (a) sensed pressure, or (b) change in pressure above an upper most check valve, or (c) a change in pressure between the valve system 10 and an upstream check valve, and (d) any of one (a)-(c) together with sensed rotation of the drill string 16.

It should also be appreciated the specific construction and design of the valve system 10 is not critical to the aspects of the present disclosure relating to fluid driven downhole system or the disclosed method of adding a drill pipe to a drill string of a fluid driven downhole tool. Other forms of valve system that operate in the same or similar manner in so far as preventing the passage of fluid through a down hole tool until a selected pressure is attained may be used.

It should also be appreciated that the exemplary embodiments of the valve system and associated compressed fluid driven downhole system are only examples, and are not intended to limit the scope, applicability, or configuration of the present disclosure in any way. Rather, the foregoing detailed description will provide those skilled in the art with a convenient road map for implementing an exemplary embodiment of the disclosed valve system and associated compressed fluid driven downhole system.

In the claims which follow, and in the preceding description, except where the context requires otherwise due to express language or necessary implication, the word "comprise" and variations such as "comprises" or "comprising" are used in an inclusive sense, i.e., to specify the presence of the stated features but not to preclude the presence or addition of further features in various embodiments of the system and method as disclosed herein.

The invention claimed is:

1. A fluid driven downhole system comprising:

a tubular forming a fluid flow path, the tubular having an up hole end and a down hole end;

a downhole tool, coupled to the downhole end of the tubular, capable of being driven by fluid; and a valve system coupled to the tubular and located up hole of the downhole tool and down hole of the up hole end of the tubular, the valve system being operable to selectively: open the fluid flow path allowing fluid to flow to drive the downhole tool; and, close the fluid flow path preventing fluid from flowing to and out of the downhole tool, the valve system including an actuator, a controller having a rotation sensor for sensing a rotational state of the valve system, a fluid supply line capable of communicating fluid pressure in the fluid flow path to the actuator, wherein, the actuator is operable to move the valve system between the opened and closed position on the basis of any one of, or any combination of two or more of: rotation of the tubular; fluid pressure within the tubular; a particular or specific rotation sequence of the downhole tool; the effluxion of time; vertical movement of the downhole tool; depth of the downhole tool; a pressure differential; and, air fluid flow rate though the tubular.

2. The fluid driven downhole system of claim 1 wherein the valve system is arranged to open when pressure of the fluid in the tubular reaches a threshold pressure.

3. The fluid driven downhole system of claim 2 wherein the threshold pressure is a pressure between ambient downhole pressure and operating pressure of the downhole tool.

4. The fluid driven downhole system of claim 2 wherein the valve system is arranged to allow a small bleed of compressed fluid to pass in its closed state.

5. The fluid driven downhole system of claim 1 wherein the valve system is controlled to open when the tubular is rotating.

6. The fluid driven downhole system of claim 1 including one or more check valves located in the fluid flow path between the valve system and the up hole end of the tubular, the one or more check valves arranged to allow a flow of fluid in a down hole direction only.

7. The fluid driven downhole system of claim 1 wherein the downhole tool is a drilling tool and the tubular is a drill string comprises of a series of end to end connected drill pipes.

8. The fluid driven downhole system of claim 1 wherein the valve system is arranged to open incrementally between the open and closed positions.

9. The fluid driven downhole system of claim 1 wherein the valve system includes:

a valve located in the fluid flow path, the valve being progressively movable between a fully open position in which fluid can flow past the valve and through the fluid flow path without restriction, and a closed position in which compressed fluid is prevented from passing the valve and flowing through the fluid flow path to the down hole tool; and an actuator arranged to move the valve between the opened position and the closed position dependent on at least one of: a rotational state of the tubular; and a pressure differential between a fluid in the fluid flow path and a reference pressure.

10. The fluid driven downhole system of claim 9 wherein the valve system includes an accumulator, and wherein the actuator is selectively exposed on one side to pressure within the fluid flow path, and exposed on an opposite side to pressure within the accumulator.

11. The fluid driven downhole system of claim 1 wherein the controller includes an internal valve arranged to open and close fluid communication between the fluid flow path and the fluid supply line.

* * * * *